US005655963A

United States Patent [19]

Paschke et al.

[11] Patent Number: 5,655,963

[45] Date of Patent: Aug. 12, 1997

[54] AIR-RELEASING ENDCAP FOR FABRIC AIR DISPERSION SYSTEM

[75] Inventors: Nick Paschke, Platteville, Wis.; Ron Snyder, Peosta, Iowa

[73] Assignee: Rite-Hite Corporation, Milwaukee, Wis.

[21] Appl. No.: 566,866

[22] Filed: Dec. 4, 1995

[51] Int. Cl.[6] ..... F24F 13/072

[52] U.S. Cl. ..... 454/297; 454/306; 454/903

[58] Field of Search ..... 454/284, 306, 454/903, 296, 297, 298

[56] References Cited

U.S. PATENT DOCUMENTS

| | | | |
|---|---|---|---|
| 2,595,408 | 5/1952 | Quest | 454/903 X |
| 3,919,929 | 11/1975 | Harmon | 454/306 X |
| 5,044,259 | 9/1991 | Catan et al. | 454/306 |

FOREIGN PATENT DOCUMENTS

| | | | |
|---|---|---|---|
| 26 56 415 | 6/1978 | Germany | 454/306 |
| 6-94295 | 4/1994 | Japan | 454/903 |

*Primary Examiner*—Harold Joyce

*Attorney, Agent, or Firm*—Leydig, Voit & Mayer, Ltd.

[57] ABSTRACT

A fabric air dispersion device system with a fabric tube, and a closure attached to an open end of the tube, the closure being movable between a closed, blocking position, and an air-releasing position wherein forced air in the tube can flow past the closure and out of the tube. The closure moves to the air-releasing position when the end of the tube is compressed from an inflated configuration to a compressed configuration. The closure is preferably formed of a plurality of closure members which include free edges, the members being in an overlapped configuration to prevent the free passage of forced air when the tube end is in the inflated configuration. Upon compression of the tube end, the free edges of the flaps move relative to one another to expose an area through which the forced air can flow. A compression member is provided to compress the end of the tube to move the closure to the air-releasing position.

9 Claims, 4 Drawing Sheets

AIR-RELEASING ENDCAP FOR FABRIC AIR DISPERSION SYSTEM

FIELD OF THE INVENTION

The invention relates generally to air handling systems employing fabric air dispersion devices, and more particularly to a fabric dispersion device including an endcap that can be opened to allow the exit of air.

BACKGROUND OF THE INVENTION

Ductwork is typically employed in combination with air-handling units (heaters, air-conditioners, filters, humidifiers, de-humidifiers, etc.) for conveying and distributing air from the air-handling unit to a room or other enclosure. Ducts are typically formed of a rigid metal material such as steel, aluminum, or stainless steel. In many environments, ducts are hidden above suspended ceilings. In warehouses, manufacturing plants and other similar buildings, however, the ducts are suspended from the roof of the building and are thus exposed. Metal ducts may be problematic in those warehouse or manufacturing environments where prevention of air-borne contamination of the inventory is critical. For example, temperature variations in the enclosure, or temperature differentials between the ducts and the air being conveyed can lead to condensation of moisture on the ducts. The presence of such moisture may in turn lead to the formation of mold or bacteria on the duct, which is then distributed through the enclosure by the air passing through the ducts. Further, in the case of exposed ducts, condensation on the exterior of the duct can result in such condensation dripping from the duct onto the inventory or personnel below. Further still, ducts often have a layer of insulation bounded to the exterior by a further layer of aluminum. The insulation layer ages and deteriorates as the duct cycles through natural temperature-induced size variations. As a result, the deteriorated insulation material may fall from the ducts.

Indeed, given this potential for contamination, the type of metal ducts that can be used in certain facilities may be subject to government regulation, which typically adds to the cost of using metal ducts. Food-processing facilities, under USDA regulation, have been required to use expensive, non-toxic sealed and insulated stainless steel ducts. As an alternative, such facilities could not use ducts at all. This may also be problematic as the air that cycles through the air-handling unit is not conveyed and distributed to the entire enclosure, but rather only cycles in the vicinity of the air-handling unit.

Metal ducts may also be problematic in that they promote drafts, creating localized temperature variations within a facility. As is well known, metal ducts include spaced diffusers to allow the air flowing through the duct to be distributed into the room in which the duct is located. Even so, the position of the duct and the flow rate therethrough can lead to undesirable local temperature variations. For example, the required controlled temperature in certain food-processing facilities is 42 degrees F. A food-handling worker standing just beneath a vent or diffuser in such an installation may have a draft of the cooled air blowing directly on him, while the worker next to him will not be subjected to such a draft. Such drafts can lead to lower productivity or even health problems for prolonged exposure.

A solution to both the expense of certain metal ducts and to the problem of drafts and uneven temperature distribution may be found in fabric air dispersion devices. Fabric air dispersion devices, such as that sold under the name DUCT-SOX by Frommelt Safety Products of Dubuque, Iowa, are simply soft-sided tubes made of a fabric which may be air-porous. Such air-porous fabric air dispersion devices typically do not include openings or vents as in conventional ducts. Rather, the fabric air dispersion devices contain the forced air and inflate under the velocity pressure and static pressure from the air-handling unit to which they are attached. Given that the fabric is air-porous, however, the contained forced air slowly leaks out of the fabric air dispersion device along its entire length. Such a device thus provides an even temperature distribution without drafts. Moreover, such fabric air dispersion devices are easy to manufacture, inexpensive to ship (because of reduced weight and damage) and install, and are typically much less expensive than their metal duct counterparts. Such fabric air dispersion devices have been approved by the USDA for certain food-handling installations.

A potential disadvantage of fabric air dispersion devices, however, is their tendency to accumulate moisture in high humidity situations. For example, in certain food-handling facilities, a high-pressure, high-temperature steam wash-down of the facility walls, equipment, floors, etc. must be performed daily. This significantly raises the humidity in the room. Although, by nature, the air-handling unit may be equipped to reduce such humidity, the air must be cycled through it repeatedly to gradually lower the humidity. Accordingly, high humidity air passes through the fabric air dispersion device. The humid air flow through the pores of the fabric may result in the accumulation of water condensation on the fabric. This is not only undesirable from the standpoint of potentially impairing the function of the device, but also because it reduces the rate of humidity reduction. A potential solution to this situation is to remove the fabric air dispersion devices during the wash-down operation. Given the simplicity of device installation, this could be done without significant effort. However, the absence of a means for conveying and distributing the air from the air-handling unit inhibits circulation of the air from the air-handling unit and through the entire room or enclosure, which circulation is helpful in uniformly reducing the humidity level in the room. Rather, the result is a significant reduction in humidity adjacent the air handling unit, or units, but continued high humidity elsewhere.

SUMMARY OF THE INVENTION

It is thus primary aim of the invention to allow fabric air dispersion devices to have the ability to operate in high humidity environments.

In accordance with that aim, it is a primary object of the invention to provide a fabric air dispersion device that performs in a conventional manner in low humidity situations, but that can be adapted to perform in high humidity situations.

A further related object is to avoid the need to remove fabric air dispersion devices for high humidity situations.

A related object is to prevent the undue accumulation of moisture in the fabric air dispersion device during high humidity situations.

A further related object is to reduce the amount of leakage through the fabric during high humidity situations.

In accordance with these and other objects of the invention, there is provided a fabric air dispersion device including a fabric tube with a closure attached to a distal end thereof, the closure being selectively movable between a closed position, wherein the closure is a barrier to free passage of forced air from a forced air source, and an air-releasing position, wherein the closure allows limited free passage of forced air. The opening of the closure reduces the static pressure causing the normally-desired leakage. As a result, less air leaks through the fabric and air moves through the device at a higher velocity. As a result, in high humidity situations, condensation on the fabric from the high humidity air is reduced. At the same time the air from the source (preferably an air handling unit) is largely conveyed through the tube and out the open closure, thus providing circulation of the air, and promoting dehumidification. At the same time, the circulation of the continually drier air through the device helps to dry out any moisture that may have accumulated in the fabric during the high humidity situation. Once the humidity is returned to an acceptable level, the closure may be closed to return the fabric air dispersion device to normal operation.

In the preferred embodiment, the fabric air dispersion device is provided with a compression member for compressing the portion of the tube adjacent the closure from an inflated configuration to a compressed configuration. It is this compressing of the compression member and the tube adjacent thereto that moves the closure from the closed to the air-releasing position. Toward that end, the preferred embodiment of the closure includes a plurality of closure members, each including a free edge and an edge portion which is securable to the perimeter of the fabric tube. The closure members are disposed to overlap, so that the overlapped closure members form a barrier to free passage of the forced air with the tube end in the inflated configuration. The free edges are disposed so as to be movable relative to each other in response to the compression member compressing the end of the tube. This relative movement exposes an area allowing the forced air in the tube to pass therethrough. The pressure of the forced air as exerted on the closure in the closed position may also assist in moving the closure members relative to each other in response to the compression of the end of the tube.

Other objects and advantages of the invention will be apparent upon reference to the attached specification and drawings, wherein:

DESCRIPTION OF THE PREFERRED EMBODIMENTS

Figure 1:
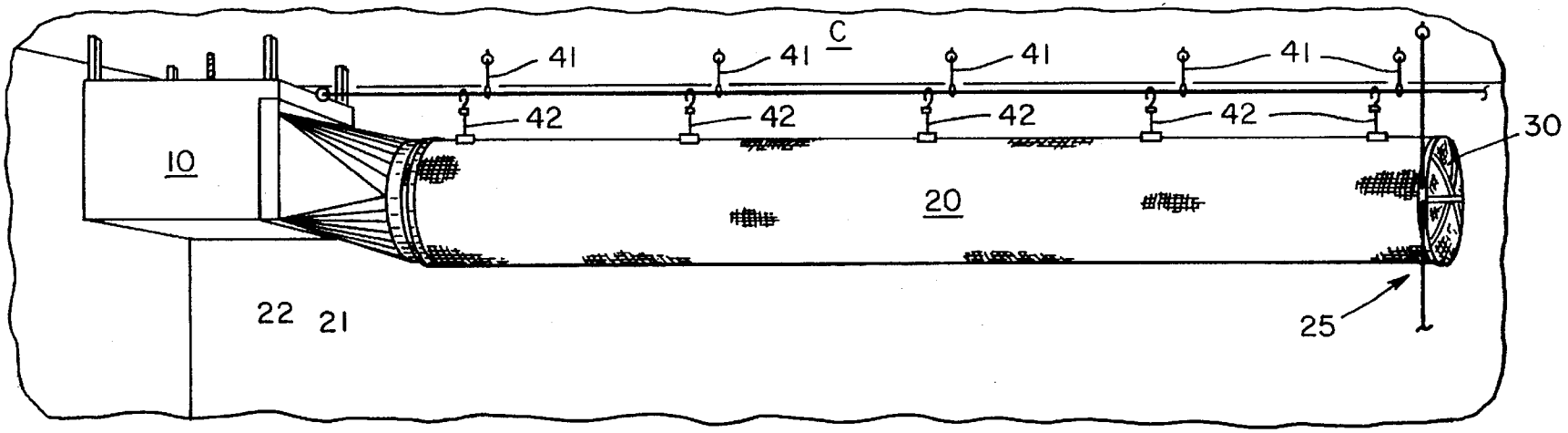
FIG. 1 is an environmental view of a fabric air dispersion device according to the invention with the closure in the closed position.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

The fabric air dispersion device of the present invention distributes air from a forced air source to a room or other enclosure. An example of an air dispersion device according to the present invention is shown in an illustrative operating environment in FIGS. 1 and 2. In this example, the source of forced air is an air handling unit 10 attached to a ceiling C. The device according to the invention comprises a fabric tube 20 with a first end 21 and a distal end 25. The first end is coupled to the source of forced air. In the present embodiment, the coupling of the first end 21 to the air handling unit 10 is in the form of a fabricated baffle 22. A variety of other means for coupling the end 21 of the tube 20 to the air handling unit 10 could be used. In the present embodiment, the distal end 25 of the tube 20 is at the end of a straight length of tube. However, as will be appreciated by one of skill in the art, other "distal ends" are also possible. For instance, the tube 20 could include a "T" member branching therefrom. Each of the ends of the T would be a distal end within the meaning of the invention. The term distal end is meant simply to include an end of tube 20 that not attached to the source of forced air.

The tube 20 may be suspended from the ceiling C, illustratively by means of a simple cable system. A supporting cable 40 is suspended from the ceiling C by means of spaced supports 41. The ends of the cable are also secured. The fabric tube is then hung from the cable 40 by means of clips 42 (illustratively made of nylon) attached to and spaced along the tube 20. In the present embodiment, the clips are shown attached in the 12 o'clock position. In other embodiments of the invention, it may be advantageous to dispose two sets of clips—one in the 10 o'clock position, and the other in the 2 o'clock position. Of course, this would require two separate cables 40. Alternatively, a variety of other means could be used for suspending the tube 20 from the ceiling. Given the minimal weight of the air dispersion device according to the invention, an inexpensive and simple suspension system can be used.

The distal end 25 of the tube 20 has a closure 30 attached thereto. In FIG. 1, the closure is shown in a closed position, in which the closure is a barrier to the free passage of the forced air from the air handling unit 10 past the distal end 25. Accordingly, with the closure closed as in FIG. 1, the forced air is trapped within the fabric tube 20. The static pressure and velocity pressure caused by this trapping of the air causes the tube 20 to inflate to the configuration shown in FIG. 1. Although not shown, the tube 20 also assumes an uninflated configuration when the source of forced air is removed. The exact shape of the tube 20 in the uninflated configuration depends on the positioning of the suspension system and the cross-section of the tube itself.

To allow the air trapped within the tube 20 to leak out and deliver the air from the air handling unit to the room, the fabric comprising tube 20 is air-porous. The presently-preferred fabric for tube 20 is a spun polyester that is calendared into sheets, and that has a weight of 6.96 ounces/sq. yard. Presently, the preferred material is that supplied by Wellington Sears of Valley, Ala. under style #2522, 3×1 twill. The sheets are then simply sewn into the tubular configuration shown in FIGS. 1 and 2. It should be noted that although the fabric tubes shown herein are circular in cross section, other cross-sectional shapes, such as a square could also be used. The fabric for forming the tubes 20 is available in a variety of pore sizes, which affect the leakage rate. In order for the tube 20 to properly inflate, and then leak the trapped air at the proper rate to the room, the leakage rate of the tube must be chosen in light of the output of the air handling unit 10. For an air handling unit having a larger output, a larger pore size must be used, and vice versa.

For a properly chosen tube 20, the forced air from the air handling unit is evenly distributed to the room in which the tube 20 is located. Unlike conventional ducts, fabric tube 20 does not include spaced openings that can lead to drafts and localized temperature variations. Rather, the air is uniformly leaked from the tube 20, thus leading to an even temperature distribution without the creation of drafts. The fabric forming tube 20 may also be advantageously provided with an anti-microbial coating, such as "Microbe Shield" sold by Aegis, Inc. of Midland, Mich. Since the leaking air passes through the fabric, such an anti-microbial coating allows the air dispersion device according to the invention to filter out potentially harmful air-borne microbes.

Figure 2:
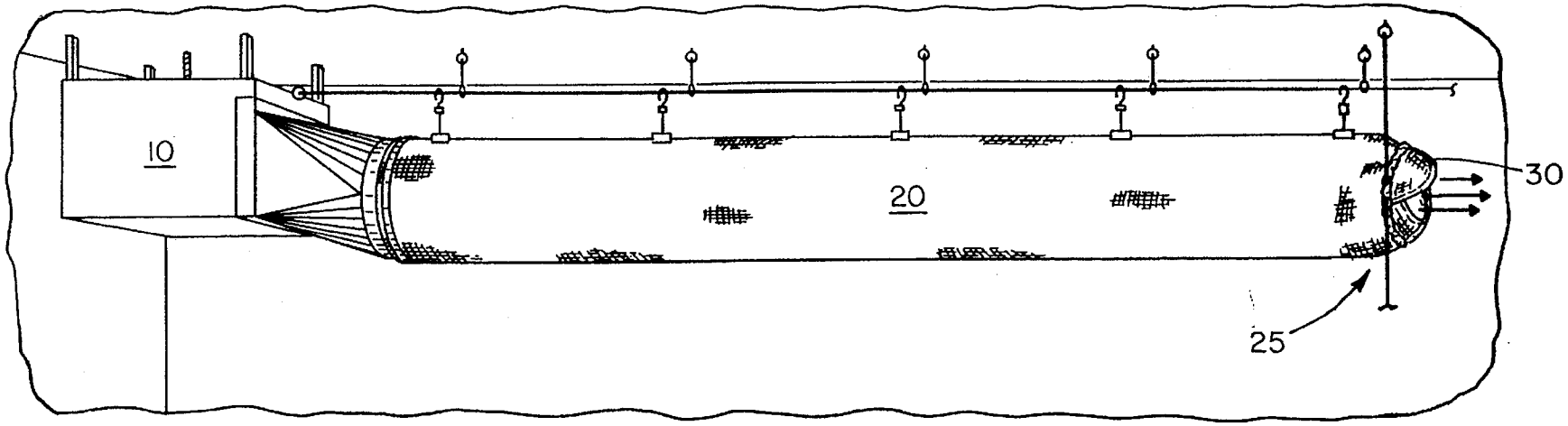
FIG. 2 is an environmental view of a fabric air dispersion device according to the invention with the closure in the air-releasing position.

To prevent the tube 20 from accumulating excess moisture in high humidity situations, the air dispersion device according to the invention can assume the configuration shown in FIG. 2, in which the closure 30 is shown in an air-releasing position. The feature of selective positioning of the closure 30 between the closed position of FIG. 1 and the air-releasing position of FIG. 2 forms a significant aspect of the invention. In situations where high humidity air is passed through the tube 20, such as following a steam-heated washdown of the room in which the tube 20 is located, a fabric air dispersion device in the configuration of FIG. 1 could accumulate moisture. This accumulation results from the high-humidity air leaking through the pores of the fabric forming tube 20. The moisture in the leaking air may tend to cling to the small pores, thus wetting the tube 20. With the fabric air dispersion device in the air-releasing configuration of FIG. 2, however, the leakage rate through the tube 20 is reduced, as a significant amount of the forced air simply exits through the closure 30 in the air-releasing position, as depicted by the arrows in FIG. 2. The lower leakage rate through the remainder of the tube 20 lowers the rate at which water will accumulate in the pores of the fabric. At the same time, forced air passes along and through the tube 20. This increased movement of air in the tube 20 helps to dry out any water accumulated in the fabric.

Figure 3:
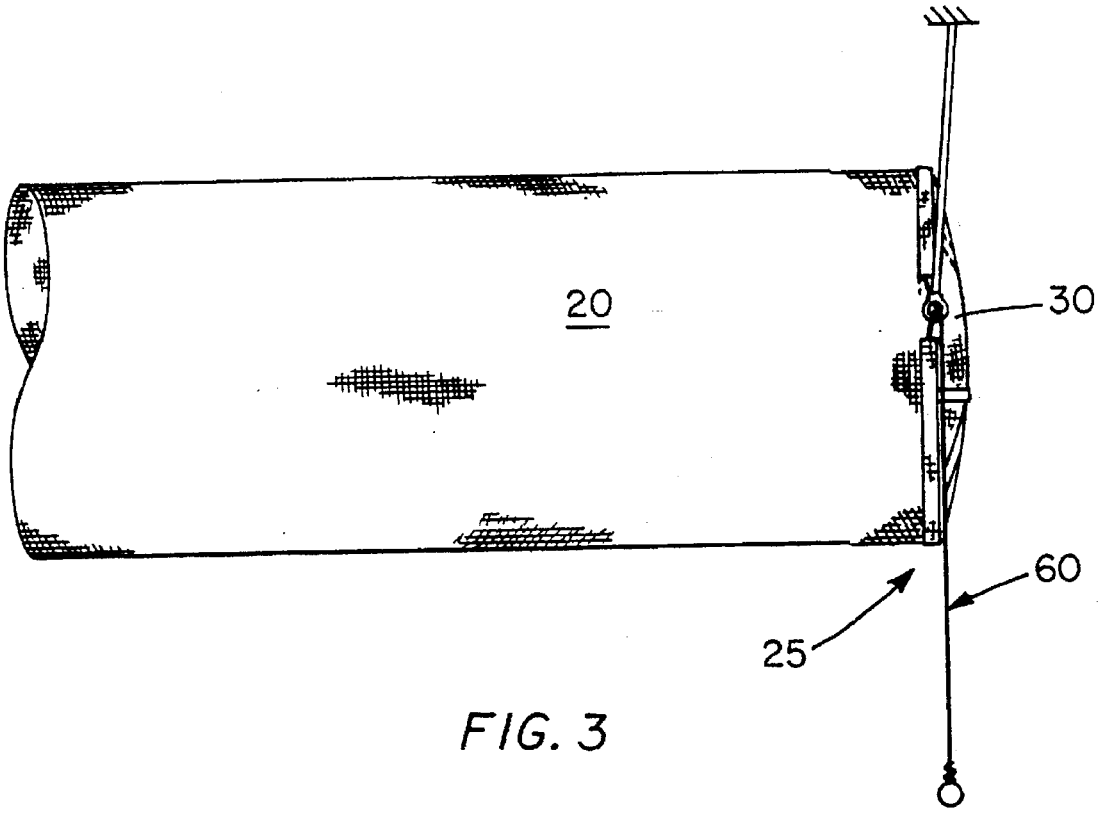
FIG. 3 is a detailed side view of the fabric air dispersion device including the closure according to an embodiment of the invention.
Figure 5:
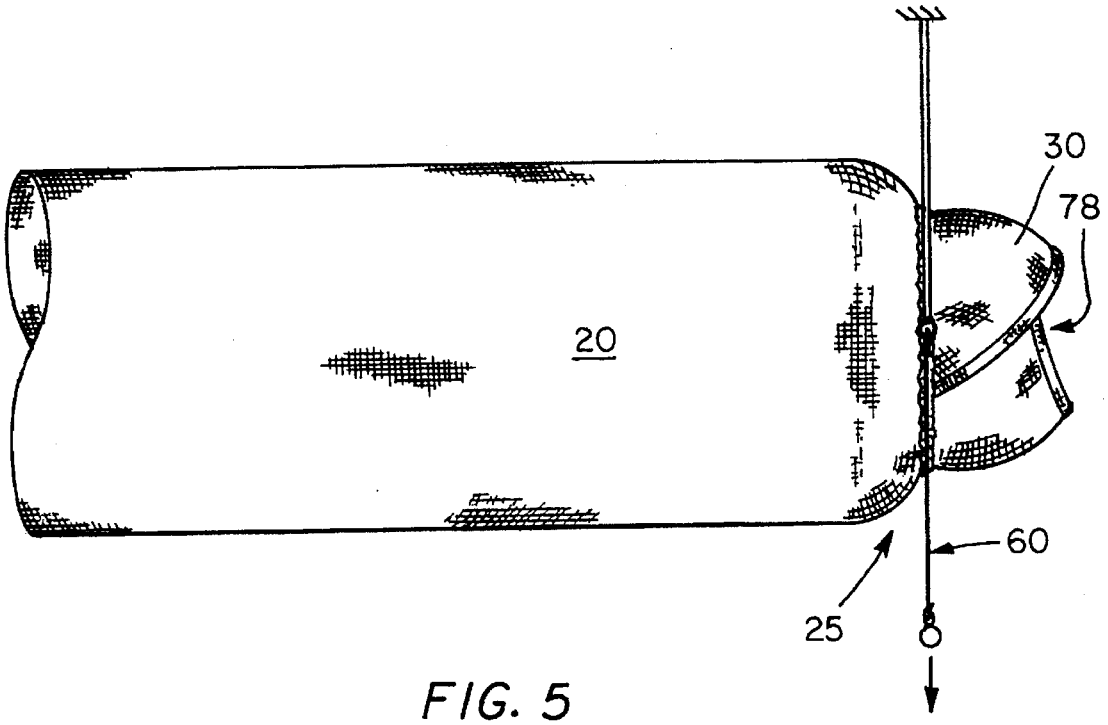
FIG. 5 is a detailed side view of the fabric air dispersion device including the closure according to an embodiment of the invention, with the closure in the air-releasing position.
Figure 6A:
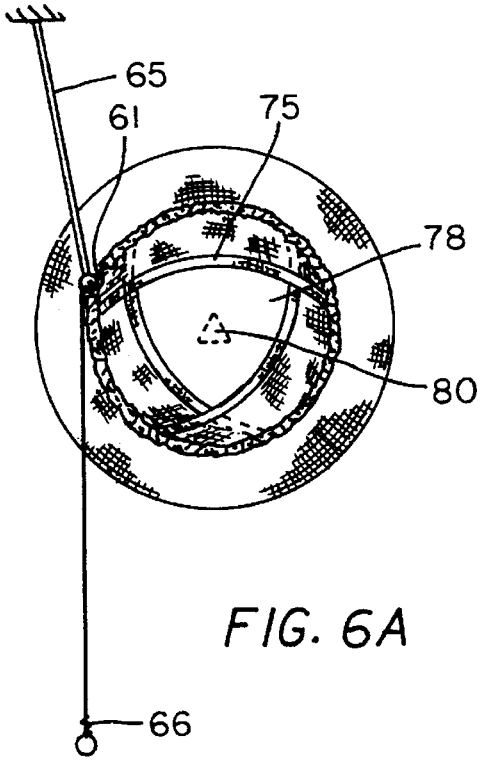
FIG. 6A is an end view of the system of FIG. 5.

The closure member 30, according to the present embodiment, is disposed so as to move into the air-releasing position of FIG. 2 in response to compression of the distal end 25 of the tube 20. Since the tube 20 is formed of a fabric that is inflated by the static pressure and velocity pressure created by forced air from unit 10 impinging on closure 30, the distal end is compressible between the inflated configuration, shown in FIG. 1, and the compressed configuration, shown in FIG. 2. More detailed views of the distal end 25 in the inflated configuration, and of the closure 30 in the closed position can be seen in the elevation and end views of FIGS. 3 and 4. FIGS. 5 and 6A show the distal end 25 in the compressed configuration, and the closure 30 in the air-releasing position.

Figure 6B:
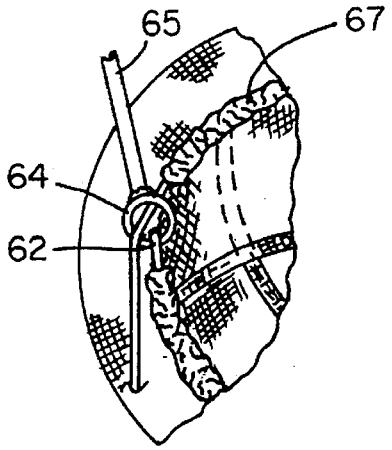
FIG. 6B is a detailed view of the compression member of FIG. 6A.

To compress the distal end to the compressed configuration, and to thus place the closure 30 in the air-releasing position, a compression member is provided. In the present embodiment, the compression member is in the form of a cinch 60, which is disposed about the distal end 25 of the tube 20. The cinch 60 is a length of rope or cable that includes a loop portion 61 which is looped around the distal end 25. A first end 62 of the cinch 60 is secured to a vertically stationary object, such as the ring 64, shown in detail in FIG. 6B. In the present embodiment, the ring 64 is held in place vertically by attachment to a cable 65 suspended from the ceiling C. The second end 66 of the cinch 60 hangs free, and can be actuated by pulling, either manually or by other means. Pulling on the second end 66 causes the length of the loop portion 61 to be reduced from an inflated length shown in FIG. 4 to the compressed length shown in FIG. 6. As the cinch 60 is adjusted to the compressed length, the distal end 25 of the tube 20 is compressed into the compressed configuration, thus causing the closure 30 to move to the air-releasing position. When the cinch 60 is released, the internal static pressure and velocity pressure in the tube 20 returns the distal end 25 to the inflated configuration.

As will be appreciated by one of skill in the art, a variety of other cinches or compression members could be used within the scope of the present invention. For example, although the cinch 60 is shown as having an end 62 fixed to a vertically stationary member 64, a stationary member is not required. All that is required is that the length of cinch 60 which engages the tube 20 be adjustable so that adjustment of the cinch 60 to the compressed length causes the distal end 25 of the tube to be compressed, thus allowing the closure 30 to open. Further, the free end of the cinch 60 need not hang downwardly. Rather, it could be disposed horizontally, or in other orientations. The means for securing the cinch to the tube 20 could also be varied. In the present embodiment, the tube 20 is provided with a sleeve 67 secured thereto, and within which the cinch 60 is received. The sleeve could be replaced with spaced loops or the like. Alternatively, a portion of the cinch could be secured directly to the end 25 of the tube itself. Further, the compression member of the invention need not be a cinch at all. Rather, other mechanical or electrical devices could be used for the purpose of compressing the end 25 of the tube to the compressed configuration.

The presently preferred embodiment of the closure 30 will now be described in greater detail with regard to FIGS. 3–6. Closure 30 is formed of a plurality of closure members, illustratively in the form of flaps 70. The flaps 70 may be formed of the same fabric material as the remainder of the tube 20, or other pliable material may be used. In the present embodiment, three flaps 70 are shown, although as few as two could be used. More than three flaps could also be used. Each closure member or flap 70 includes an edge portion 71, which is securable to the perimeter of the distal end 25 of the tube 20. Presently, the edge portion of a flap 70 is sewn to the distal end 25, although other means of securement could be used, such as zippers and the like. Since the tube 20 in the present embodiment is circular in cross-section, the edge portions of the flaps 70 is also part-circular, but other shaped tubes and flaps 70 could also be used.

Each flap 70 further includes a free edge, such as edge 75 shown in the Figures. Preferably, the free edge 75 of a given flap 70 is reinforced by doubling or tripling the fabric back upon itself, and hemming it. Further, although the edges 75 are shown as straight in the present embodiment, they could also be curved, or have other more complex contours. Edge 75 is referred to as "free" since it is not secured to any other structure. As will be described below, the free edges of the flaps 70 are thus capable of moving relative to each other in response to movement of the distal end 25 of the tube to the compressed configuration to thereby move the closure 30 to the air-releasing position. With the distal end in the inflated configuration, however, the closure members are disposed to overlap.

Figure 4:
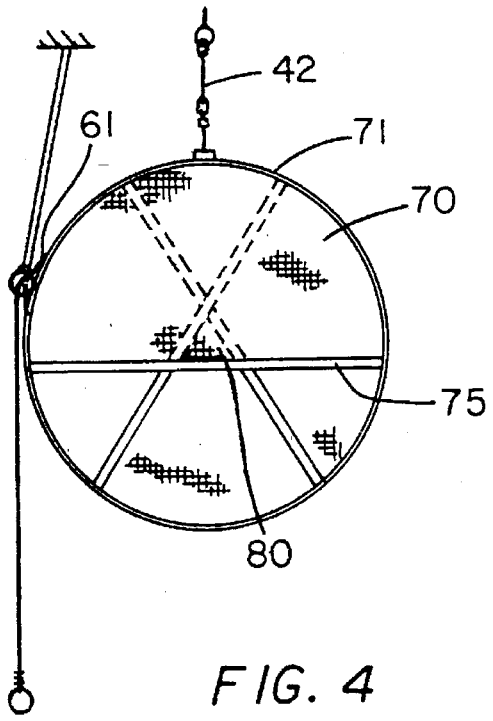
FIG. 4 is an end view of the system of FIG. 3.
Figure 7:
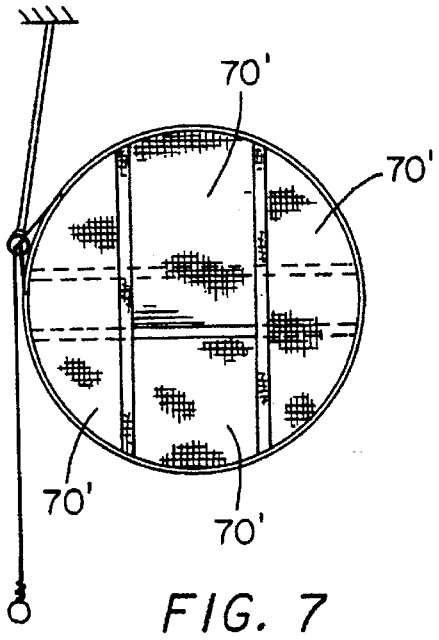
FIG. 7 is an end view of an alternative embodiment of a closure according to the invention, in the closed position.

In the present embodiment, the flaps 70 all overlap in a common overlap region 80, as in FIG. 4. It will be appreciated that the three flaps 70 partially overlap in regions beside the overlap region 80. However, overlap region 80 represents the region where all of the flaps 70 intersect. With the flaps 70 overlapped in this manner, and with the tube 20 in the inflated configuration, the flaps 70 are stretched flat and serve as a barrier to the free passage of forced air through the closure 30. Accordingly, the tube 20 operates in a normal manner with the static pressure and velocity pressure inflating the tube 20, and leading to the controlled leakage of the forced air out of the tube. Although the flaps 70 in the present embodiment overlap in the common overlap region 80, such is not required. Rather, the flaps 70 could be disposed so as to overlap and present a barrier to free passage of forced air, but not overlap in a common overlap region. An example of such a configuration of flaps 70', according to an alternative embodiment of the invention, is shown in FIG. 7.

Figure 8:
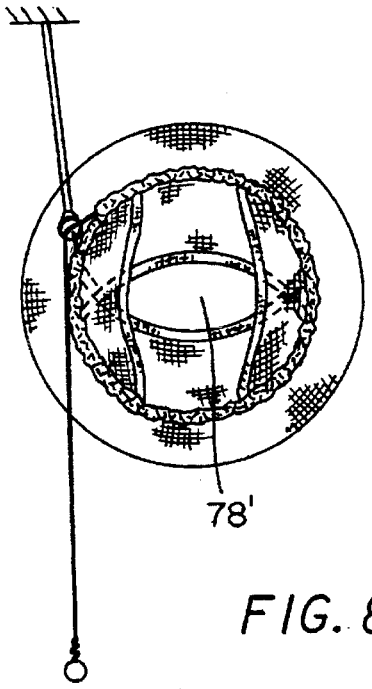
FIG. 8 is the closure of FIG. 7, in the air-releasing position.
Figure 9:
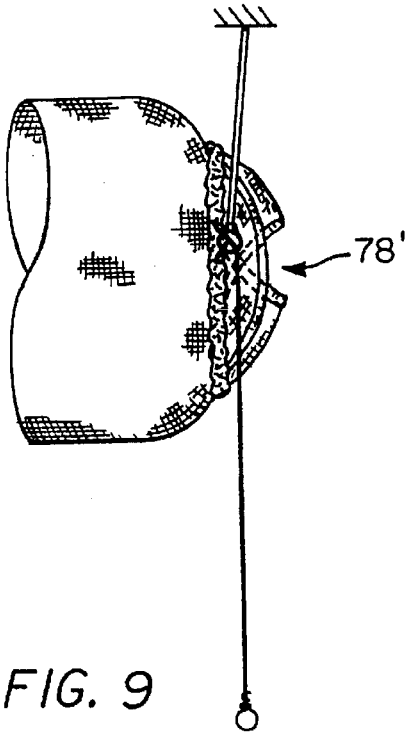
FIG. 9 is the closure of FIG. 8, in an end view.

Upon compression of the distal end of the tube 25 to the compression configuration the closure 30 moves to the air-releasing position, as shown in FIG. 5. The compression of the distal end 25 also compresses the edge portions 71 of the flaps 70. Accordingly, the free edges 75 are no longer stretched taut, and they are capable of movement relative to each other. The pressure exerted on the flaps 70 by the presence of the forced air in the tube 20 thus pushes outwardly (axially) on the flaps 70. The resulting movement of the flaps 70 to the position shown in FIG. 5, and the movement of the leading edges 75 relative to each other thus exposes an area 78 in the area of the closure 30, and allows forced air to flow therethrough. The exposed area 78, now exposed by the relative movement of the free edges 75, is seen most clearly in FIG. 6A, along with an outline of the overlap region 80, showing the relative size of the two regions. For the alternative embodiment of FIGS. 7–9, the exposed area 78' can be seen in FIGS. 8 and 9.

The size of the exposed area 78 when the closure is in the air-releasing position should be carefully chosen. The size should be small enough to maintain an adequate static pressure in the tube 20 to ensure that it stays inflated. If the exposed area 78 is too large, and the tube 20 is not maintained in an inflated state, fluttering of the fabric making up the tube could occur. Maintaining the tube in the inflated state is also important in the case where the pressure positively moves the end 25 back to the inflated configuration when the compression member is released. At the same time, the exposed area 78 should be large enough to ensure adequate flow past the closure 30 to provide the desirable reduced leakage rate, increased air circulation and tube drying features referred to above. At present, we have determined that the best size for the exposed area 78 is approximately ¼ the area of the closure 30 in the closed position. This gives sufficient flow to circulate air and dry the tube, and also maintains the tube in an inflated state to prevent fluttering and to allow the closure to close when the cinch is released.

There has thus been disclosed a fabric air dispersion device with a fabric tube, and including a closure attached to an open end of the tube, the closure being movable between a closed, blocking position, and an air-releasing position wherein forced air in the tube can flow past the closure and out of the tube. Preferably, the closure moves to the air-releasing position when the end of the tube is compressed from an inflated configuration to a compressed configuration. The closure is preferably formed of a plurality of closure members which include free edges, the members being in an overlapped configuration to prevent the free passage of forced air when the tube end is in the inflated configuration. Upon compression of the tube end, the free edges of the flaps move relative to one another to expose an area through which the forced lair can flow. A compression member is provided to compress the end of the tube to move the closure to the air-releasing position.

What is claimed is:

1. An air dispersion device for conveying and distributing a source of forced air, the device comprising, in combination:

a fabric tube, including a first end coupled to the source of forced air, and a distal end, the fabric tube being air-porous to allow controlled leakage of the forced air through the fabric;

a closure attached to the distal end, the closure being selectively movable between a closed position, wherein the closure is a barrier to free passage of the forced air past the distal end, and an air-releasing position, wherein the closure allows limited free passage of forced air past the distal end.

2. The device of claim 1, wherein the distal end of the fabric tube is compressible between an inflated configuration and a compressed configuration, and wherein the closure is disposed to move to the air-releasing position in response to compression of the distal end to the compressed configuration.

3. The device of claim 2, and including a compression member disposed about the distal end of the fabric tube, the length of the compression member being adjustable between an inflated length and a compressed length for compressing the distal end to the compressed configuration.

4. The device of claim 3, wherein the closure comprises a plurality of closure members, each closure member including an edge portion securable to the perimeter of the distal end and a free edge, the closure members being disposed to overlap to form a barrier to free passage of the forced air with the distal end in the inflated configuration; the free ends of the closure members being disposed to be movable relative to each other in response to adjustment of the compression member to the compressed length to expose an area through which forced air may pass.

5. The device of claim 4, wherein the closure members are disposed to overlap in a common overlap region, and wherein the free edges are movable relative to each other in response to adjustment of the compression member to the compressed length to expose the overlap region and allow forced air to pass therethrough.

6. The device of claim 1, wherein the cross-section of the fabric tube is circular.

7. The device of claim 1, wherein the fabric tube is coated with an anti-microbial material.

8. The device of claim 3, wherein the compression member is a cinch disposed about the distal end of the fabric tube.

9. A closure assembly for attachment at the end of a fabric tube that conveys and distributes a source of forced air, a distal end of the tube being compressible between an inflated configuration and a compressed configuration, the closure assembly comprising:

a plurality of closure members, each closure member including an edge portion securable to the perimeter of the distal end and a free edge, the closure members being disposed to overlap to form a barrier to free passage of the forced air with the distal end in the inflated configuration;

a compression member disposed adjacent the distal end, and adjustable between an inflated length and a compressed length for compressing the distal end to the compressed configuration;

the free ends of the closure members being disposed to be movable relative to each other in response to adjustment of the compression member to the compressed length to expose an area through which forced air may pass.

* * * * *